US008167175B2

(12) United States Patent
Jaouen

(10) Patent No.: US 8,167,175 B2
(45) Date of Patent: May 1, 2012

(54) APPLICATOR BOTTLE

(76) Inventor: Jean Jacques Jaouen, Gloucester, VA (US)

( * ) Notice: Subject to any disclaimer, the term of this patent is extended or adjusted under 35 U.S.C. 154(b) by 97 days.

(21) Appl. No.: 12/821,658

(22) Filed: Jun. 23, 2010

(65) Prior Publication Data

US 2011/0024464 A1 Feb. 3, 2011

Related U.S. Application Data

(60) Provisional application No. 61/230,569, filed on Jul. 31, 2009, provisional application No. 61/262,243, filed on Nov. 18, 2009.

(51) Int. Cl.
*B67D 7/78* (2010.01)

(52) U.S. Cl. ..... 222/145.5; 222/387; 222/145.6

(58) Field of Classification Search ..... 222/145.5, 222/145.6, 386–393
See application file for complete search history.

(56) References Cited

U.S. PATENT DOCUMENTS

| | | | | |
|---|---|---|---|---|
| 4,515,298 | A | 5/1985 | Czech | 222/380 |
| 6,126,043 | A | 10/2000 | Albert, II | 222/340 |
| 6,513,534 | B1 | 2/2003 | Sofer | 132/112 |
| 7,481,333 | B2 * | 1/2009 | Goldberg et al. | 222/135 |
| 7,726,520 | B2 * | 6/2010 | Harrold | 222/162 |
| 2004/0035891 | A1 | 2/2004 | Matthews | 222/386 |
| 2010/0331773 | A1 * | 12/2010 | Frederiksen et al. | 604/84 |

* cited by examiner

*Primary Examiner* — Kevin P Shaver
*Assistant Examiner* — Melvin Cartagena
(74) *Attorney, Agent, or Firm* — Miller Law Group, PLLC

(57) ABSTRACT

An applicator bottle allows the reconstitution and dispensing of a re-hydrated powdered product. The bottle has a dispenser apparatus detachably mounted on the dispensing end and a spring-loaded plunger apparatus detachably mounted on the distal end with a movable disk defining the distal end of the internal cavity within the bottle. The plunger apparatus includes a telescoping plunger spring-loaded to extend toward the dispensing end and a locking mechanism that will restrain the plunger apparatus in a compressed configuration until released through an external release button. A rotatable, hand-operated mixing apparatus can be mounted on either end of the bottle to provide an aggressive mixing action when needed. The plunger apparatus exerts a mechanical pressure on the reconstituted product to force the product out of the dispenser apparatus for utilization. Clean-up is facilitated by the ability to disassemble the bottle and the apparatus attached thereto.

12 Claims, 9 Drawing Sheets

Fig. 14
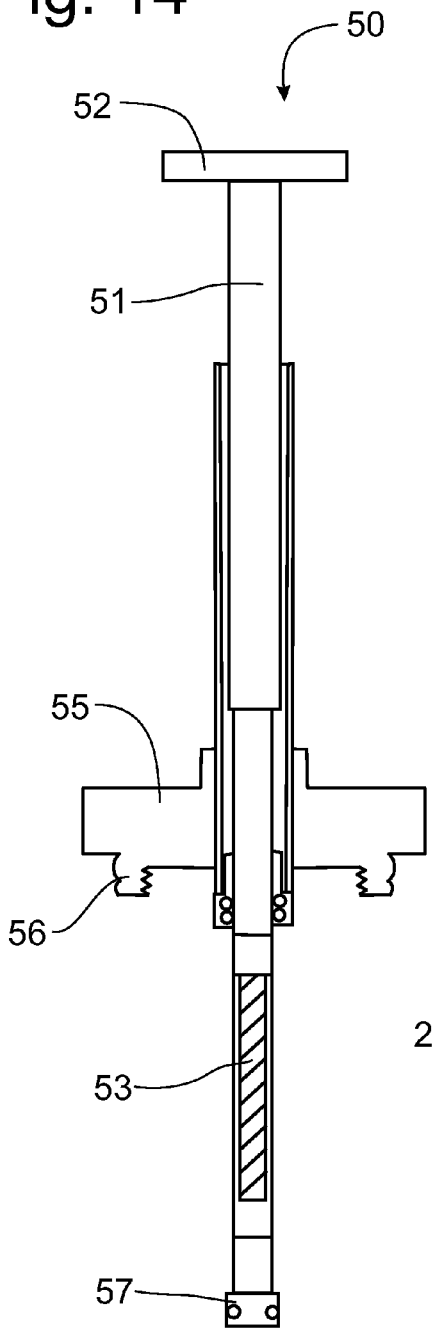
Fig. 15
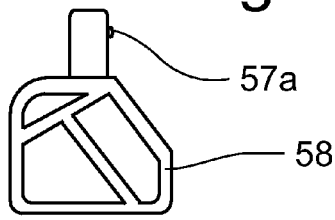
Fig. 16
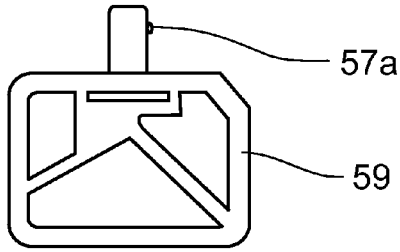
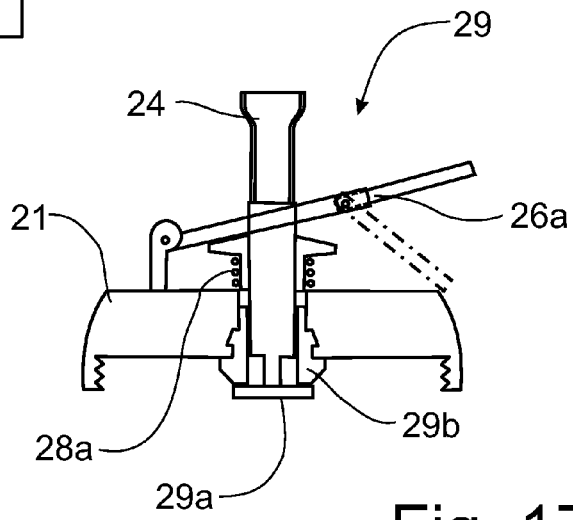
Fig. 17

APPLICATOR BOTTLE

CROSS-REFERENCE TO RELATED APPLICATIONS

This application claims domestic priority on U.S. Provisional Patent Application Ser. No. 61/230,569, filed Jul. 31, 2009, and on U.S. Provisional Patent Application Ser. No. 61/262,243, filed on Nov. 18, 2009, the contents of which are incorporated herein by reference.

FIELD OF THE INVENTION

The present invention generally relates to bottles for dispensing and applying products such as wash off face masks and foamy alginate face masks and, more particularly, to a bottle that can be reused to mix, dispense and apply the products without utilizing a gaseous propellant.

BACKGROUND OF THE INVENTION

Products such as wash off masks, which are already mixed and packaged in tubes or sachets, need preservatives because they contain water. Such prepackaged products are sold in 2 to 3 ounce minimum sizes. However, some products, such as the alginate peel off face masks, are sold in powder form and must be mixed with water or a water-based solution just before application by the esthetician. Jellification of the alginate peel off face mask product takes place in only about six minutes. Today, the alginate peel off face mask is available only as a professional product and the customer has to lie down on a table when the esthetician applies the mask. It is not possible with the present formulation to apply the mask by yourself because the product is too liquid during application and will drip if the customer stands up.

Shipment of such products in a powdered form that can be hydrated by the user would save shipping costs; however, proper mixing and hydration of the powdered product is essential for an effective and satisfactory utilization of the product. A new product formulation for alginate peel off face mask includes a natural surfactant giving the product the aspect of a foaming cream which can remain on the face without dripping when the customer is in front of the mirror. Accordingly, with a proper container to allow a mixing and dispensing of such a product, it would be possible for a customer to apply the product at home without incurring the costs of an esthetician to apply the face mask for the customer.

Accordingly, it would be desirable to provide a container that can be utilized to hydrate powdered product and provide an effective dispensing of the product once the product has been properly mixed and prepared for use.

SUMMARY OF THE INVENTION

It is an object of this invention to provide a bottle that can be utilized to reconstitute or hydrate a powdered product within the bottle and utilize that bottle to dispense the reconstituted product without requiring a gaseous propellant.

It is another object of this invention to provide a bottle in which an alginate peel-off face mask can be mixed and then dispensed by the ultimate user without utilizing a gaseous propellant.

It is a feature of this invention that the bottle includes a movable disk that establishes a watertight seal against the inside of the bottle.

It is an advantage of this invention that the movable disk defines the distal end of the internal cavity of the bottle to provide an internal cavity with a variable volume.

It is another feature of this invention that a spring-loaded plunger can be mounted on the distal end of the bottle to engage the movable disk to push the movable disk toward the dispensing end of the bottle.

It is another advantage of this invention that the spring-loaded plunger exerts a pressure on the contents within the internal cavity of the bottle to urge the contents toward the dispenser apparatus at the dispensing end of the bottle.

It is another feature of this invention that the dispenser apparatus at the dispensing end of the bottle is detachable from the bottle.

It is still another feature of this invention that the spring-loaded plunger is detachably mounted on the distal end of the bottle.

It is yet another object of this invention that either of the dispenser apparatus or the spring-loaded plunger can be replaced by a mixing apparatus to provide an enhanced mixing action to reconstitute powered product within the internal cavity of the bottle.

It is still another advantage of this invention that the powered product can be reconstituted simply by shaking the bottle with the powder and a hydrating liquid placed into the internal cavity.

It is yet another advantage of this invention that a hydrating liquid that is not conducive to being easily mixed with a powdered product can be mixed by the mixing apparatus placed on one end of the bottle, preferably the dispensing end, to provide an aggressive agitation of the powdered product and hydrating liquid.

It is a further advantage of this invention that the mixing apparatus can be provided with interchangeable mixing heads to provide different aggressive actions for mixing different hydrating liquids.

It is a further feature of this invention that the mixing head is mounted for rotational movement when the mixing handle is moved longitudinally.

It is still another object of this invention to provide a spring-loaded mechanism that will assert a mechanical pressure on a reconstituted product within the internal cavity of the bottle.

It is still another feature of this invention that the spring-loaded plunger apparatus includes a telescoping plunger that utilizes a spring to push against the underside of the movable disk to assert a mechanical force on the reconstituted product to urge the product toward the dispenser apparatus.

It is yet another feature of this invention that the spring-loaded telescopic plunger incorporates a locking mechanism that secures the plunger apparatus in a compressed configuration until selectively released to exert mechanical pressure on the reconstituted product within the internal cavity of the bottle.

It is still another advantage of this invention that the plunger apparatus can be locked into the compressed configuration before being attached to the distal end of the bottle.

It is yet another advantage of this invention that the locking mechanism can be released externally to allow a mechanical pressure to be exerted on the reconstituted product within the internal cavity of the bottle.

It is yet another object of this invention to provide a mixing and dispensing bottle for reconstituting and dispensing a rehydrated powered product which is durable in construction, inexpensive of manufacture, carefree of maintenance, facile in assemblage, and simple and effective in use.

These and other objects, features and advantages are accomplished according to the instant invention by providing a mixing and dispensing bottle for the reconstitution and dispensing of a re-hydrated powdered product. The bottle has a dispenser apparatus detachably mounted on the dispensing end and a spring-loaded plunger apparatus detachably mounted on the distal end with a movable disk defining the distal end of the internal cavity within the bottle. The plunger apparatus includes a telescoping plunger spring-loaded to extend toward the dispensing end and a locking mechanism that will restrain the plunger apparatus in a compressed configuration until released through an external release button. A rotatable, hand-operated mixing apparatus can be mounted on either end of the bottle to provide an aggressive mixing action when needed. The plunger apparatus exerts a mechanical pressure on the reconstituted product to force the product out of the dispenser apparatus for utilization. Clean-up is facilitated by the ability to disassemble the bottle and the apparatus attached thereto.

BRIEF DESCRIPTION OF THE DRAWINGS

The advantages of this invention will be apparent upon consideration of the following detailed disclosure of the invention, especially when taken in conjunction with the accompanying drawings wherein:

FIG. 14 is a partial cross-sectional view of the mixing apparatus mountable on either end of the bottle;

FIG. 15 is an elevational view of a first embodiment of a mixing head for the mixing apparatus shown in FIG. 11;

FIG. 16 is an elevational view of a second embodiment of a mixing head for the mixing apparatus shown in FIG. 11; and FIG. 17 is a cross-sectional view of an alternative embodiment of a dispenser apparatus detachably mountable on the dispensing end of the bottle.

DETAILED DESCRIPTION OF THE PREFERRED EMBODIMENT

Figure 1:
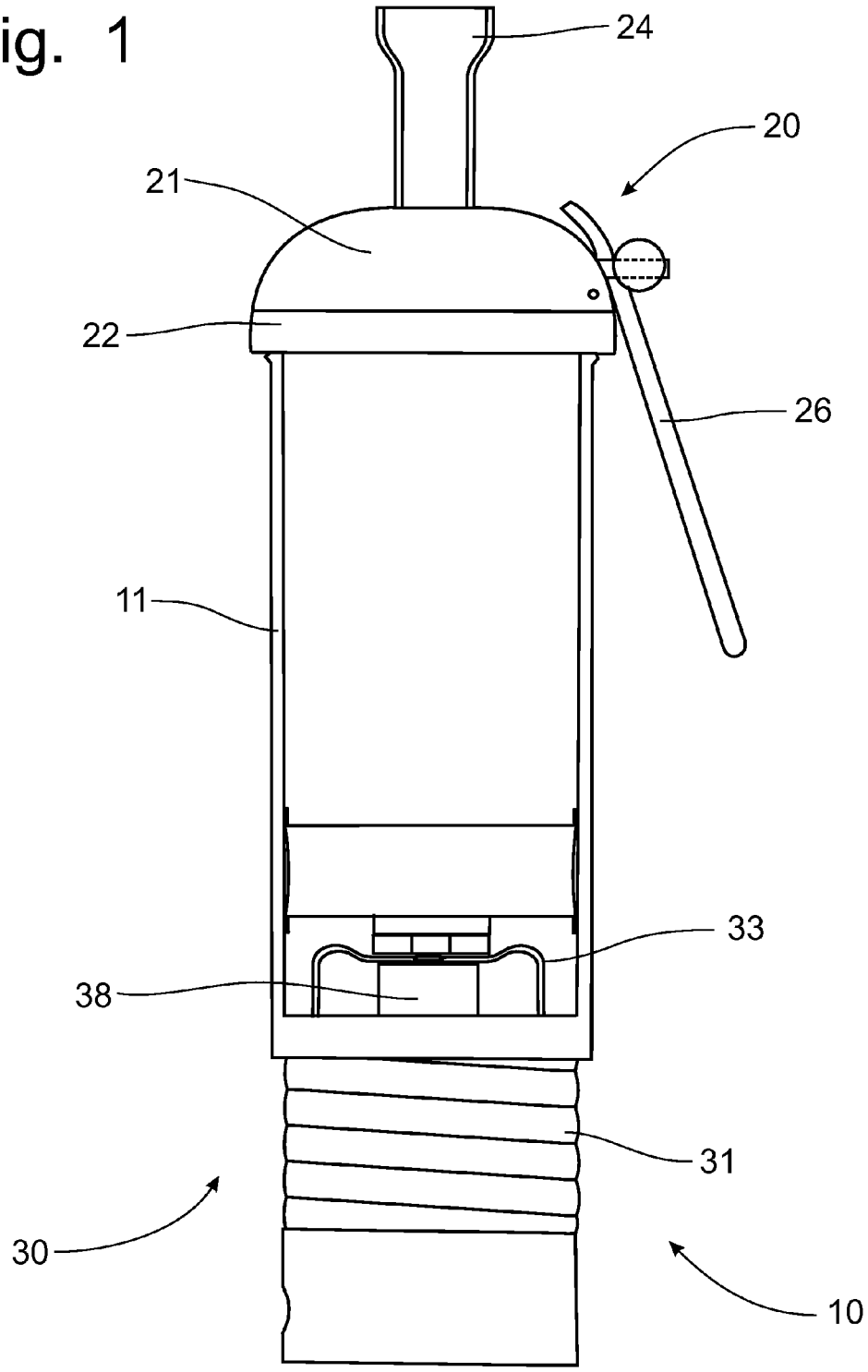
FIG. 1 is an elevational view of an applicator bottle incorporating the principles of the instant invention, a dispenser apparatus being detachably mounted on the dispensing end of the bottle and a plunger apparatus being detachably mounted on the distal end of the bottle, the plunger apparatus being locked in the compressed configuration.
Figure 2:
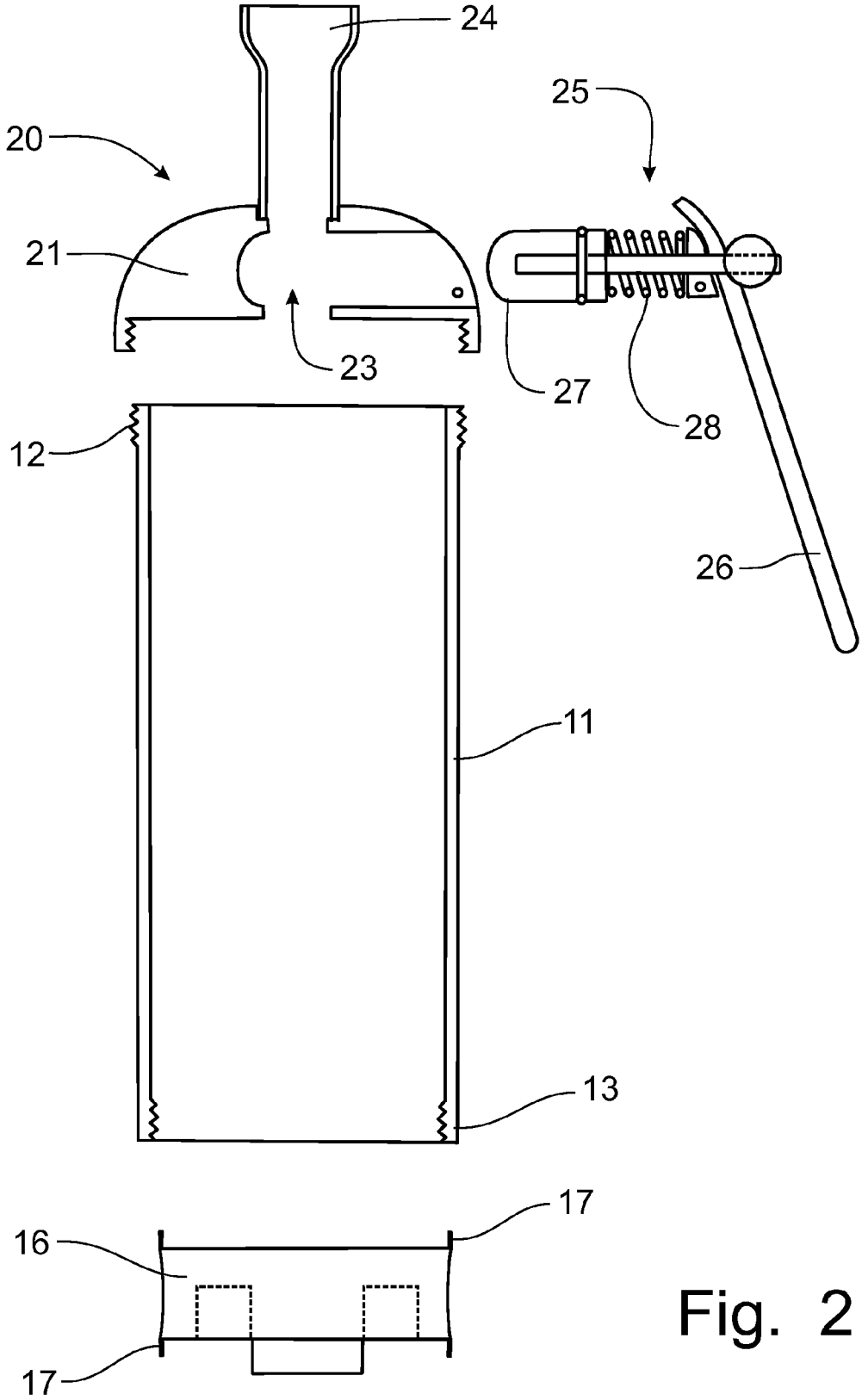
FIG. 2 is an exploded cross-sectional view of the dispenser apparatus and the bottle with movable disk member.
Figure 3:
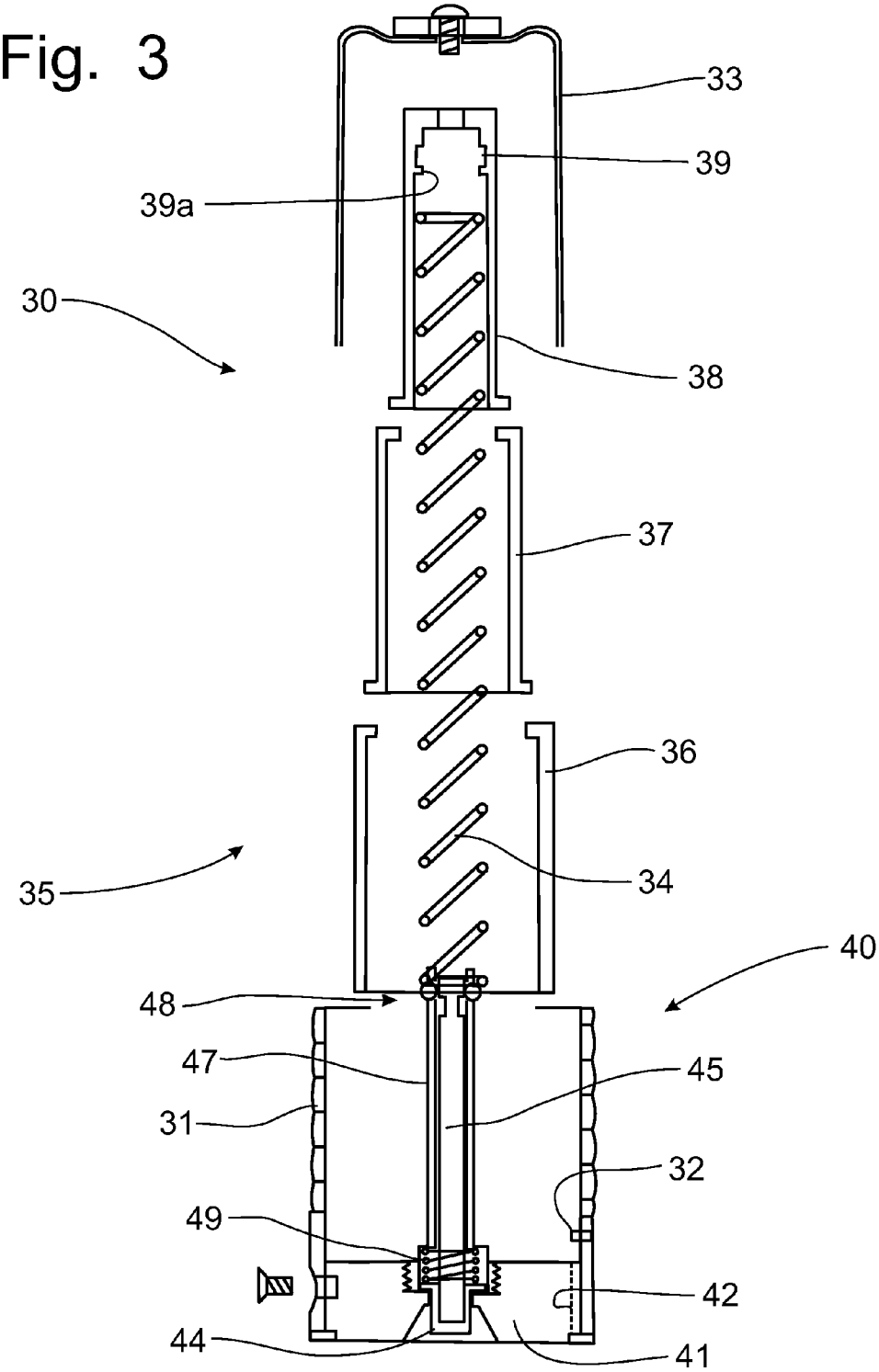
FIG. 3 is an exploded cross-sectional view of the plunger apparatus detachably mountable on the distal end of the bottle, as shown in FIG. 1.

Referring to FIGS. 1-6, an applicator bottle used for mixing and dispensing reconstituted product, incorporating the principles of the instant invention, can best be seen. The bottle 10 is configured to mix powdered product with a hydrating liquid, such as water, and provide a capability to dispense the mixed product without the use of a gaseous propellant. More specifically, the bottle 10 is designed for use with an alginate mask that is formulated to be applied to the face as a foamed cream, somewhat like shaving cream. The formulation of this is set forth below and enables a user to apply the mask at home as this alginate mask stays on the face without dripping. The cylindrically shaped bottle 10 is formed of four primary interconnectable and operably associated assemblies, including the dispenser assembly 20, the mixing chamber 15, the mixing assembly 50 and the spring-loaded piston assembly 30.

Starting first with the mixing chamber 15, the bottle 10 is formed with an outer shell 11 preferably formed with a first treaded coupling 12 at the dispensing end of the shell 11 and a second threaded coupling 13 at the distal end of the shell 11. Preferably, the first threaded coupling 12 is formed on the exterior side of the shell 11 and the second coupling 13 is formed on the interior side of the shell 11, although one skilled in the art will recognize that other configurations will work satisfactorily. Preferably, the shell 11 is formed from an acrylic so as to be somewhat transparent and permit viewing of the interior of the shell 11. The mixing chamber 15 is a cavity within the shell 11 defined by the dispenser assembly 20 at the dispensing end thereof and a movable disk 16 that can be inserted into the shell 11 through the dispensing end when the dispenser assembly 20 is removed from the shell 11.

The movable disk 16 is preferably formed with concave circumference that includes a pair of rings 17 projecting above and below, respectively, the disk 16 to sealingly engage the inner surface of the shell 11. This particular configuration of the movable disk 16 allows the disk 16 to slide along the interior of the shell 11 to form the bottom surface of the mixing chamber 15. Since the disk 16 is movable, the size or volume of the mixing chamber 15 is variable depending on where the movable disk 16 is located within the shell 11. Under normal operations, the movable disk 16 is initially positioned near the distal end of the shell 11, as will be described in greater detail below. The disk 16 is movable toward the dispenser assembly 20 to maintain mechanical pressure on the product within the bottle 10, as will also be described in greater detail below.

The dispenser assembly 20 is located at the top of the bottle 10 and includes a housing 21 formed with a threaded base member 22 that seats on the dispensing end of the outer shell 11 and is threadably engaged with the first threaded coupling 12. The threaded connection between the base member 22 and the first threaded coupling 12 can compress a gasket (not shown) within the housing 21, or otherwise seal against the shell 11 so that reconstituted or hydrating liquid within the mixing chamber 15 will not leak out of the bottle 10. One embodiment of the dispenser assembly 20 is shown in FIGS. 1-6, although one skilled in the art will understand that other equivalent dispensers can be utilized. The first embodiment of the dispenser assembly 20 includes a vertical opening 23 through the housing 21 to which a selected applicator tip 24 can be mounted for dispensing the product from within the mixing chamber 15. A spring-biased actuator valve 25 is mounted within the housing 21 for linear movement that will selectively open and block the vertical opening 23 for the selective passage of product therethrough from the mixing chamber 15. A lever 26 pivoted on the housing 21 is operable to draw the stopper 27 back against the spring 28 to open the valve 25 for the passage of product. The spring 28 will return the stopper 27 to the closed position to close the valve 25 when the manually operated lever 26 is released.

An alternative actuator valve 25 is shown in FIG. 17 in which a dispenser 29 is formed with a passageway (not shown) extending axially through the center of the dispenser 29 for the flow of product therethrough. The dispenser 29 includes a valve seat 29*a* that is engagable against the valve seal 29*b* to form a fluid-tight seal therebetween. Axial movement of the dispenser 29 into the mixing chamber 15 separates the valve seat 29*a* from the fixed valve seal 29*b* to allow liquid product to flow past the valve seat 29*a* into the passageway (not show) for discharge from the dispenser 29 through a mounted applicator tip 24. A compression spring 28*a* is seated on the housing 21 concentrically around the dispenser 29. A lever 26*a* is pivotally mounted on the housing 21 to provide leverage for depressing the spring 28*a* and extending the dispenser 29 into the mixing chamber 15 for the dispensing of the product therefrom. Optionally, the lever 26*a* can be bifurcated to allow convenient storage of the lever 26*a* with not in use.

As best seen in FIGS. 3-7, the piston assembly 30 is mounted on the distal end of the shell 11 through the second threaded coupling 13 to provide a mechanical force for dispensing the reconstituted product from the mixing chamber, as will be described in greater detail below. The piston assembly 30 is spring-loaded and extendible into the shell 11 to engage the underside of the movable disk 16 and push the disk 16 upwardly into the product within the mixing chamber 15. Preferably, The piston assembly 30 is telescopic to push the movable disk 16 to the top of the shell 11 to substantially completely expel the product from the mixing chamber.

The piston assembly 30 preferably includes a hollow tail cap member 31 formed with threading on the outer surface thereof to mate with the second threaded coupling 13 on the distal end of the shell 11. The threading along the outside of the cap member 31 extends over a majority of the outside of the cap member 31 to enable the tail cap member 31 to be positioned over a substantial range relative to the distal end of the shell 11. Furthermore, the tail cap member 31 includes an alignment pin 32 projecting interiorly for alignment of the locking mechanism 40, as will be described in greater detail below. The tail cap member 31 tail cap member 31.

Figure 4:
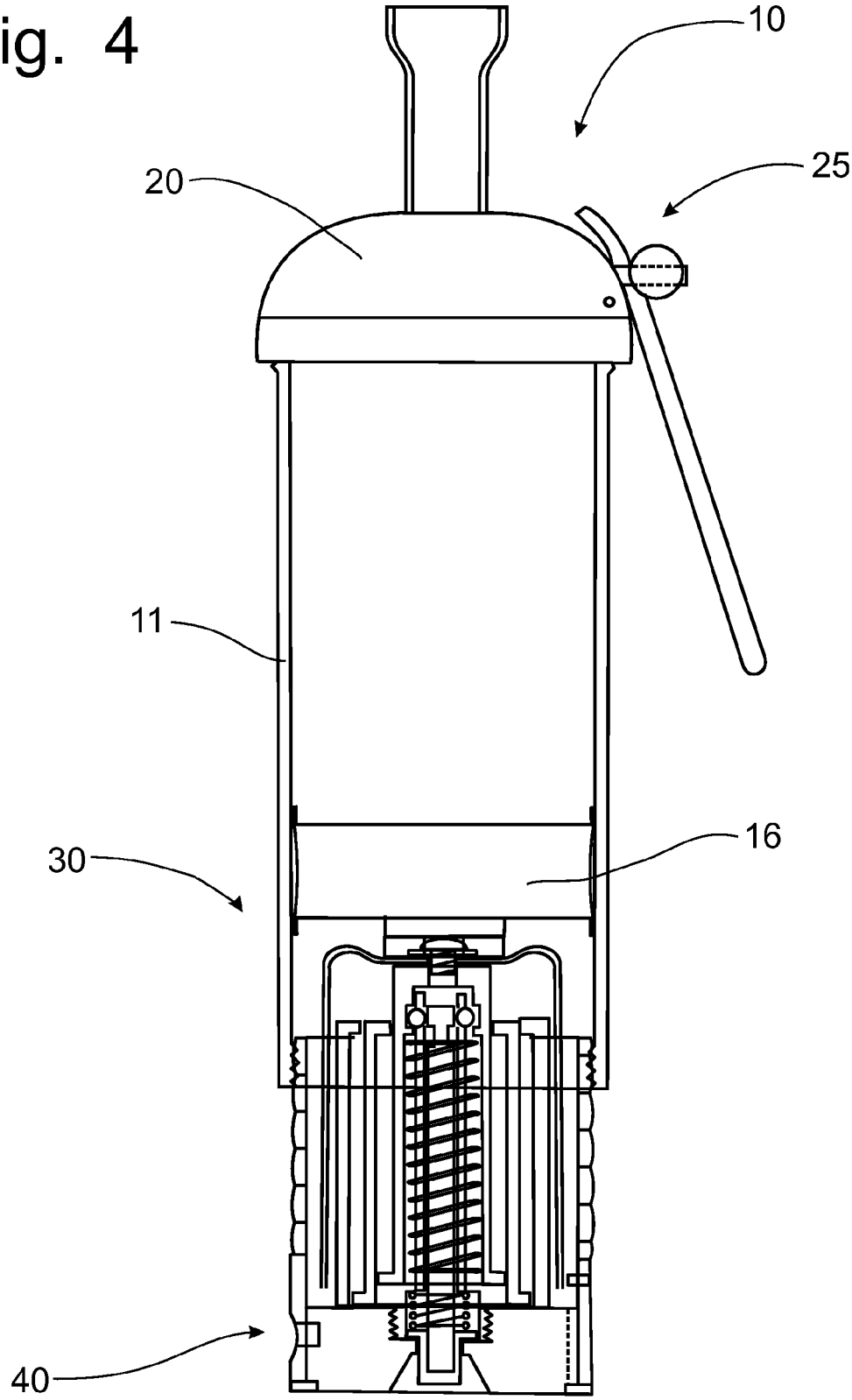
FIG. 4 is a partial cross-sectional view of the bottle shown in FIG. 1 with the plunger apparatus being in the locked configuration.
Figure 5:
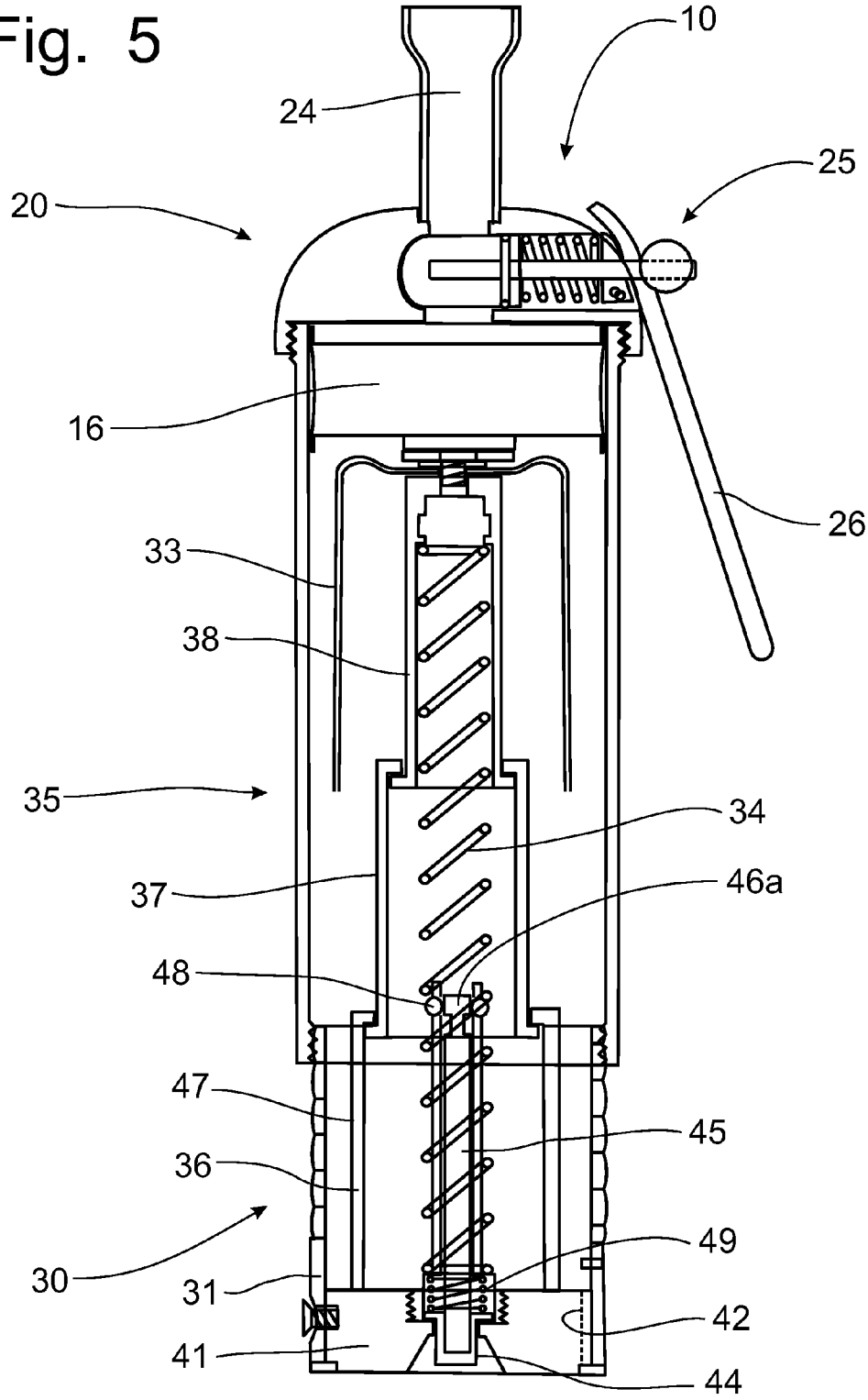
FIG. 5 is a partial cross-sectional view of the bottle similar to that of FIG. 4, but depicting the plunger apparatus fully extended to push the reconstituted product outwardly through the dispenser apparatus.
Figure 7:
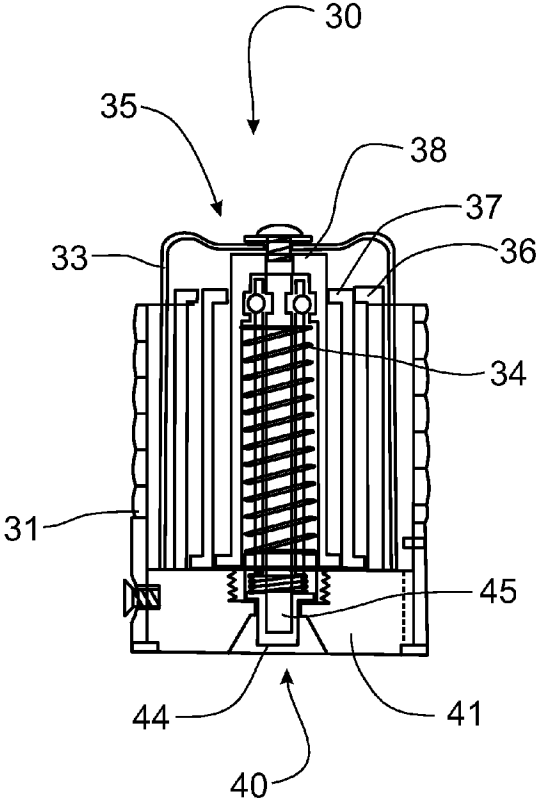
FIG. 7 is a cross-sectional view of the plunger apparatus locked into the compressed configuration before being mounted on the distal end of the bottle.
Figure 6:
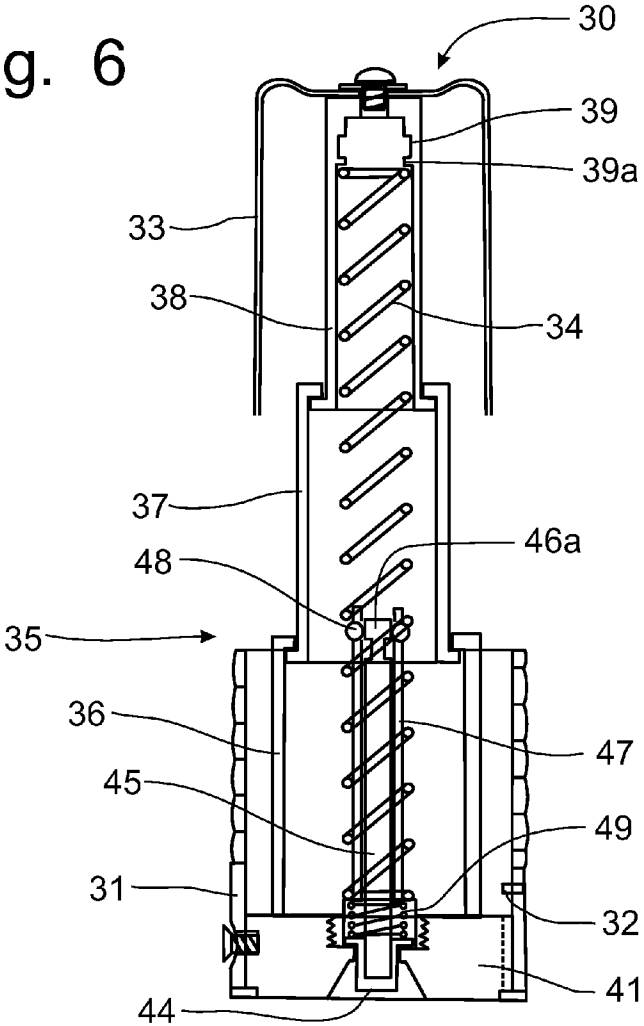
FIG. 6 is a cross-sectional view of the plunger apparatus in the fully extended orientation.

The piston assembly 30 further includes a telescopic plunger 35 having a bottom member 36, an intermediate member 37 and a pusher member 38, each of which is telescopic with respect to the other members. A compression spring 34 is housed within the telescopic plunger 35 and seated on the lock mechanism 40 to extend the plunger 35. The bottom member 36 is fixed to the lock mechanism 40 or to the tail cap member 31 by fasteners (not shown), or by threading, so that the plunger 45 is extensible from the tail cap member 31. As best seen in FIG. 5, the full extension of the plunger 35 is operable to press the movable disk 16 against the dispenser assembly 20 to expel the entire product from within the mixing chamber 15. The plunger 35 can also be provided with a decorative cap 33 that can be fastened to the end of the pusher member 38 so that when the plunger is compressed into its locked configuration, as is best seen in FIG. 4, the decorative cap 33 covers the plunger 35.

The lock mechanism 40 is seen in FIGS. 3-7. The lock mechanism 40 includes a base member 41 that is sized to fit within the bottom of the tail cap member 31. The base member 41 is formed with a vertical slot 42 that allows the passage of the alignment pin 32 so that the seating of the base member 41 within the tail cap member 31 results in an alignment of the screw holes in the tail cap member 31 and the base member 41 so that the tail cap member 31 can be secured to the base member 41 with a fastener. The lock member 40 is formed with a vertical center post 45 formed with a relief 46 near the upper end thereof. A vertically slidable sleeve 47 surrounds the center post 45 and carries a pair of opposing transversely movable detent balls 48 near the upper end thereof. The sleeve 47 is biased upwardly by a compression spring 49 so that the detent balls 47 are transversely aligned with the head 46*a* of the center post 45, pushing the detent balls 47 transversely outwardly.

Figure 9:
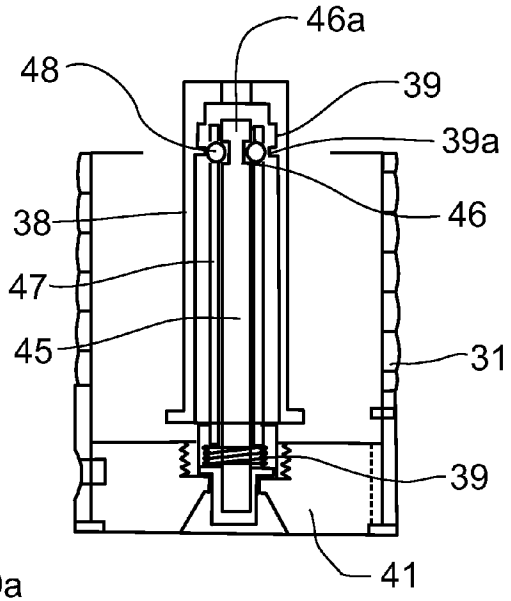
FIGS. 8 through 13 are cross-sectional views of the locking mechanism showing the progress of the locking sequence.
Figure 10:
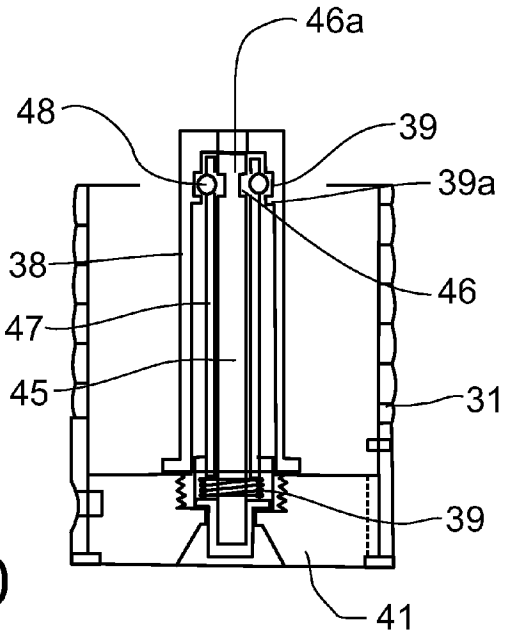
Figure 8:
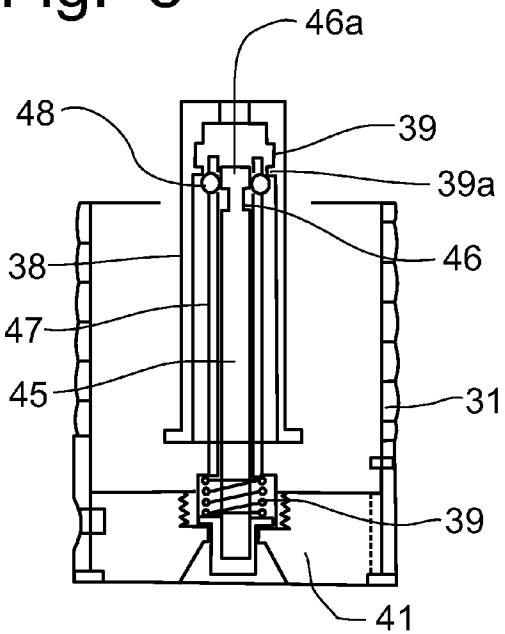

Looking at FIGS. 8-13, the operation of the lock mechanism 40 can best be seen. The initial position of the lock mechanism 40 is representatively shown in FIG. 8 with the detent balls 47 being aligned with the head 46*a* of the center post 45. Thus, when the pusher member 38 is compressed downwardly into the bottom member 36, the internal ring 33*a* cannot move past the detent balls 47 since the detent balls 47 are prevented from moving inwardly because of the engagement thereof with the head 46*a*. As a result, the continued downward movement of the pusher member 38 compresses the sleeve 47 against the compression spring 49 until the detent balls 48 become aligned with the relief 46 in the center post 45 below the head 46*a*, as is depicted in FIG. 9. Once the balls 48 have become aligned with the relief 46, the internal ring 33*a* can pass below the detent balls 48 as the balls 48 are moved into the relief 46, as is depicted in FIG. 10.

Figure 12:
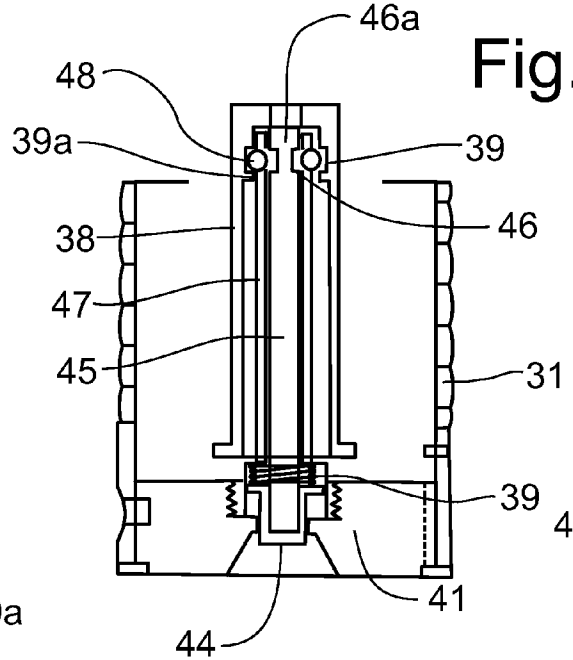
Figure 13:
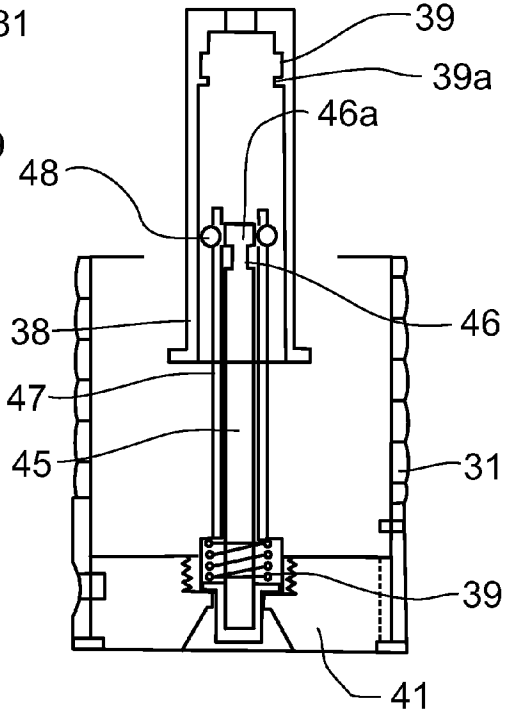
Figure 11:
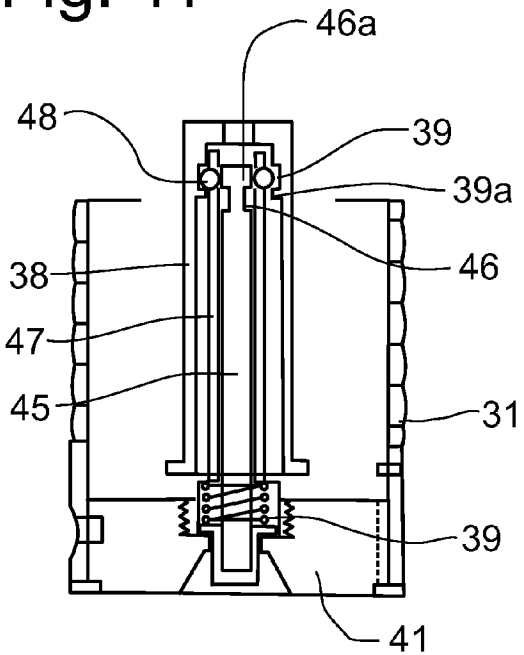

Once the internal ring 46*a* passes below the detent balls 48, the downward force exerted on the sleeve 47 to compress the spring 49 disappears and the sleeve 47 is free to return to it prior vertical position by the expansion of the spring 49, as is depicted in FIG. 11. As the sleeve 47 moves upwardly, the detent balls 48 are engaged by the underside of the head 46*a* and forced outwardly into the groove 39 formed in the top of the pusher member 38, trapping the internal ring 33*a* below the detent balls 48. At this point the lock mechanism 40 restrains the plunger 45 in its compressed form shown in FIG. 7, with the spring 34 compressed between the upper end of the pusher member 38 and the base member 41. When the plunger 45 is to be released from this compressed configuration shown in FIG. 7, the operator depresses the release button 44 into the bottom of the base member 41 which compresses the spring 49 against the sleeve 47 and extends the center post 45 upwardly into the pusher member 38 until the relief 46 is transversely aligned with the detent balls 48, as is shown in FIG. 12. When the detent balls 48 have space to move laterally, the pressure exerted by the internal ring 33*a* due to the compressed spring 34 pops the detent balls 48 into the relief 46 and the plunger 45 is released to expand telescopically, which is depicted in FIG. 13.

The mixing apparatus 50 is representatively shown in FIG. 14-16. Instead of the mixing apparatus being retained on the bottle 10, the mixing apparatus 50 is configured to be removable from the bottle 10 when the mixed product is ready to be dispensed. The mixing apparatus 50 is formed with an actuator handle 51 connected to a push member 52 that is formed with a spiral groove internally thereof. A driven rod 53 is received within the push member 52 and connected through the spiral groove within the push member 52 so that the downward movement of the push member 52 over the driven rod 53 causes the driven rod 53 to rotate about an axis of rotation corresponding to the driven rod 53. An internal spring can be provided to bias the actuation handle 51 upwardly.

The push member 52 and the driven rod 53 are movably received through the mounting cap 55 which is preferably formed with two sets of threads on a circular threaded member 56 so that the internal set of threads can engagable with the mounting threads on the exterior a small bottle 10 and the external threads can engage with internal mounting threads on the interior of the larger bottle 10. Alternatively, the threaded couplers can be sized that the mixing apparatus 50 can be mounted on either the dispensing end of the bottle 10 or on the distal end of the bottle 10. A connector 57 is formed on the distal end of the mixing apparatus 50 for the detachable mounting of an mixing head 58, 59 to be driven by the driven rod 53. A detent mechanism 57*a* retains the selected attachment head 58, 59 on the mixing apparatus 50 for rotational operation within the bottle 10 in response to the vertical movement of the actuation handle 51 and push member 52.

As can be seen representatively in FIGS. 15 and 16, many different attachment heads 58, 59 can be utilized by the mixing apparatus 50, depending on the product being mixed and the outcome that is desired. For example, the first mixing blade 58 shown in FIG. 15 can stir the product to be mixed within the mixing chamber. A more aggressive beater paddle 59 is depicted in FIG. 16. Another possible attachment head can include a wire whisk attachment to provide a gentler mixing action. All of the attachment heads 58, 59 could be formed in sizes that correspond to each of the bottle sizes, although a smaller version can often provide sufficient mixing action for a larger bottle 10, as well as a smaller version.

In operation, the bottle 10 is readied to receive and mix the product to be dispensed therefrom. The dispenser assembly 20 is removed from the dispensing end of the bottle 10, as is the piston assembly 30, and the movable disk 16 is manually pushed to the distal end of the bottle 10. The piston assembly 30 is manually compressed into the locked, compressed configuration shown in FIG. 7, and can be threaded onto the second threaded coupler 13 at the distal end of the shell 11 before or after the mixing of the reconstituted product. Depending on the product to be reconstituted and the components thereof, the product can be re-hydrated by adding the required amount of hydrating liquid and the powdered product, then replacing the dispenser assembly 20 and shaking the bottle 10 until the powdered product is reconstituted. If more aggressive mixing is required to re-hydrate the powdered product, the mixing apparatus 50 can be mounted on the first threaded coupler 12 and operated until the powdered product is re-hydrated. Then the mixing apparatus 50 is removed and the dispenser assembly 20 re-mounted on the dispensing end of the bottle 10.

The reconstituted product within the mixing chamber 15 of the bottle 10 can be pressurized mechanically, as is generally described above. The piston assembly 30 can be screwed onto the second threaded coupler 13 in the compressed configuration and then released by depressing the release button 44 so that the plunger can telescopically extend into engagement with the bottom of the movable disk 16. The spring force from the compression spring 34 will drive the movable disk 16 upwardly against the liquefied product within the mixing chamber until the compression of the product is balanced with the spring force from the compression spring 34. The spring 34 will exert a continuous upward force into the movable disk 16, and thus onto the liquefied product, to drive the reconstituted product through the dispenser apparatus 20 when the lever actuator valve 25 is operated. The compression spring 34 will continue to exert mechanical pressure on the reconstituted product until the disk 16 has moved to the dispenser assembly 20 and substantially all of the product has been dispensed. Then the bottle 10 and the various components can be disassembled and cleaned.

By forming the mixing apparatus 50 as a component that can be selectively attached to the bottle to perform the mixing function, the mechanical pressurizing apparatus can be simplified without having to accommodate the operation of the mixing apparatus within the bottle 10 for exerting spring pressure onto the reconstituted product within the bottle to be dispensed. Furthermore, cleaning the bottle 10 and the various components thereof would also be simplified. The detachable mixing heads 58, 59, retained by the detent mechanism 57, can also provide a selective mixing action for the product to be reconstituted. Alginates, for example, required a more aggressive mixing action than a more liquid product because of the consistency of the alginate material. Thus, a beater paddle attachment head 59 would achieve better mixing results than a wire whisk attachment, for example.

Alginate masks have heretofore been applied to the human face by professionals in spas and similar facilities primarily because the alginate mask formula is applied as a liquid that has to turn into a gel. Such formulations of an alginate mask would be highly impractical to be applied by a non-professional, such as in conjunction with an "at home" application. The alginate mask formulation for use with the bottle 10 described above creates a creamy foam that does not drip from the face when applied, and thus is particularly applicable to at-home applications. The formulation is provided in powder form, as is suggested above for use with the bottle for reconstitution by adding water and mixing.

A formulation for an alginate mask product is:

| | | |
|---|---|---|
| a. | 50-87% | Filler (such as Talc) |
| b. | 10-25% | Glucose |
| c. | 1-15% | Algin |
| d. | 1-15% | Calcium Sulfate |
| e. | 1-15% | Maltodextrine |
| f. | 0.01-1.0% | Tetrasodium Pyrophosphate |
| g. | 0.01-1.0% | Surfactant (such as *Quilaja Saponaria*) |

The filler can be formed of other materials, such as corn starch and the like. The surfactant is preferably a natural product, such as Quilaja Saponaria, but can be a chemical formulation as well. Using the preferred natural components noted above, a specific product formulations would preferably be within the following ranges:

| | | |
|---|---|---|
| a. | 70-72% | Talc |
| b. | 22-15% | Glucose |
| c. | 2-4% | Algin |
| d. | 2-4% | Calcium Sulfate |
| e. | 2-3.5% | Maltodextrine |
| f. | 1-0.75% | Tetrasodium Pyrophosphate |
| g. | 1-0.75% | *Quilaja Saponaria* |

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiments of the invention; however, concepts, as based upon the description, may be employed in other embodiments without departing from the scope of the invention.

For example, one skilled in the art will recognize that the gasless applicator bottle could be utilized to mix and dispense products other than masks, including cosmetic preparations, hair treatments, lotions, crèmes, and possibly food products. The components of the piston assembly 30 can be manufactured from a variety of materials, including aluminum and/or plastic. The bottles 10 can have different diameters so that differently sized bottles 10 can be provided with the respective components sized accordingly.

Having thus described the invention, what is claimed is:

1. An applicator bottle comprising: a shell defining an internal cavity with mounting members positioned at a dispensing end and a distal end of said shell, said internal cavity defining a mixing chamber from which a liquefied product can be dispensed;

a movable disk positioned within said internal cavity and defining a movable distal end of said mixing chamber;

a dispenser apparatus selectively connectable to said mounting member at said dispensing end of said shell to regulate a dispensing of liquefied product from said mixing chamber;

a spring-loaded piston assembly selectively mountable on said mounting member at said distal end of said shell, said piston assembly being engagable with said movable disk to push said movable disk toward said dispenser apparatus and expel said liquefied product from said mixing chamber;

wherein said movable disk sealingly engages an interior surface of said shell to provide a watertight mixing chamber;

a tail cap member configured for connecting to said mounting member at said distal end of said shell; a telescopic plunger extendable from said tail cap member; and a lock mechanism to secure said telescopic plunger into a compressed configuration; and a base member supported on said tail cap member; an upright center post projecting upwardly from said base member and being formed with a head and a relief area below said head; a sleeve surrounding said center post and being vertically movable relative to said center post, said sleeve being biased into an upper position by a spring and being movable into a lower position by compressing said spring; and at least one detent ball carried by said sleeve and being laterally movable between an outward lock position when aligned with said head of said center post and an inward release position when aligned with said relief area.

2. The applicator bottle of claim 1 wherein said telescopic plunger includes a plurality of telescopic members and a compression spring housed within said telescopic members to bias said telescopic plunger toward an extended position.

3. The applicator bottle of claim 1 wherein said telescopic members include an upper pusher member engagable with said movable disk, said pusher member being collapsible into a bottom member and engagable with said lock mechanism to secure said pusher member in a compressed configuration.

4. The applicator bottle of claim 3 wherein said lock mechanism further comprises a release mechanism to selectively release said pusher member from said compressed configuration.

5. The applicator bottle of claim 4 wherein said release mechanism includes a release button mounted in said base member to selectively push said center post upwardly to align said relief area with said at least one detent ball so that said pusher member can move past said detent ball and telescope upwardly.

6. The applicator bottle of claim 1 further comprising: a mixing apparatus configured to be mounted on said mounting member at said dispensing end of said shell in lieu of said dispenser assembly to provide an aggressive mixing action for product to be reconstituted in said mixing chamber, said mixing apparatus being removable from said dispensing end of said shell when said product is reconstituted so as to be replaced by said dispenser assembly.

7. The applicator bottle of claim 6 wherein said mixing apparatus comprises:

a mounting cap being engagable with said mounting member at said dispensing end of said shell;

an elongated shaft extending through said mounting cap and terminating in a connector at a lower end thereof;

an actuator handle connected to an upper end of said elongated shaft and being movable relative to said mounting cap;

a drive mechanism to cause rotation of said elongated shaft and said connector when said actuator handle is moved relative to said mounting cap; and a detachable mixing head received within said connector to provide a mixing action to said product within said mixing chamber.

8. A method of dispensing a product from a bottle, comprising the steps of: placing a liquefied product within an internal chamber of a bottle having a movable disk forming a bottom portion of said internal chamber, said movable disk being movable along said internal chamber;

mounting a dispenser assembly on a dispensing end of said bottle to control the rate at which the liquefied product is dispensed from said internal chamber;

securing a spring-loaded piston assembly on a distal end of said bottle to be engagable with said movable disk;

exerting a spring force on said movable disk to urge said movable disk toward said dispenser assembly to expel said liquefied product through said dispenser assembly;

operating said dispenser assembly as needed to discharge said liquefied product from said internal chamber;

compressing said piston assembly into a compressed configuration;

locking said piston assembly in said compressed configuration;

threading said piston assembly on said distal end of said bottle;

releasing said piston assembly from said compressed configuration;

telescopically expanding said piston assembly until said piston assembly engages said movable disk and asserts said spring force on said movable disk;

wherein said releasing step occurs after said threading step;

pouring a hydrating liquid into said internal chamber;

adding a powdered product to be reconstituted; and mixing said powdered product and said hydrating liquid until said powdered product is reconstituted and ready to be dispensed.

9. The method of claim 8 wherein said mixing step includes the step of:

connecting a mixing apparatus on said dispensing end of said bottle before said mounting step;

then, rotating a mixing head of said mixing apparatus within said internal chamber until said powdered product is reconstituted; and then removing said mixing apparatus from said dispensing end of said bottle before said mounting step.

10. The method of claim 9 wherein said mixing step occurs before said releasing step.

11. A bottle for dispensing a liquefied product from an internal chamber within said bottle through a dispensing apparatus mounted on a dispensing end of said bottle, comprising:

a movable disk forming a bottom portion of said internal chamber, said disk being movable within said bottle to vary a volume parameter of said internal chamber;

a telescopic piston assembly movable between a compressed configuration and an extended configuration, said telescopic piston assembly being detachably mountable on a distal end of said bottle in said compressed configuration and being releasable after being mounted on said distal end of said bottle to extend from said compressed configuration into engagement with said movable disk to urge said movable disk toward said dispensing apparatus;

wherein said telescopic piston assembly includes a lock mechanism to restrain said piston assembly in said compressed configuration, said lock mechanism being selectively releasable to move said piston assembly toward said extended configuration;

a base member supported on said tail cap member;

an upright center post projecting upwardly from said base member and being formed with a head and a relief area below said head; a sleeve surrounding said center post and being vertically movable relative to said center post, said sleeve being biased into an upper position by a spring and being movable into a lower position by compressing said spring; and at least one detent ball carried by said sleeve and being laterally movable between an outward lock position when aligned with said head of said center post and an inward release position when aligned with said relief area.

12. The bottle of claim 11 wherein said dispensing apparatus is removable from said dispensing end of said bottle and replaceable with a mixing apparatus to mix a powdered product with a hydrating liquid within said internal chamber before being dispensed therefrom.

* * * * *